US005526877A

United States Patent [19]

Winz

[11] Patent Number: 5,526,877

[45] Date of Patent: Jun. 18, 1996

[54] OIL WELL HEAD CLEANING SYSTEM

[76] Inventor: Frank S. Winz, 164 S. Absaroka St., Powell, Wyo. 82435

[21] Appl. No.: 369,519

[22] Filed: Jan. 5, 1995

[51] Int. Cl.[6] ..... E21B 37/00

[52] U.S. Cl. ..... 166/88.2; 166/90.1

[58] Field of Search ..... 166/75.1, 78, 81, 166/82, 88, 90, 91, 170, 173, 311

[56] References Cited

U.S. PATENT DOCUMENTS 2,522,444 9/1950 Grable ..... 166/81

3,322,198 5/1967 McHenry ..... 166/81

*Primary Examiner*—Michael Powell Buiz

*Attorney, Agent, or Firm*—Risto A. Rinne, Jr.

[57] ABSTRACT

A system for cleaning a string of an oil well that includes a washing unit having a first section and a second section that are placed atop an oil well head. The washing unit includes a center opening larger than the outside diameter of the string and includes a plurality of hoses for directing a fluid that is supplied under pressure to a plurality of nozzles, the plurality of nozzles being disposed on the center opening. The system relies upon either a rod table or a tubing slip to support the weight of the string as it is being extracted and to transfer the weight of the string to the washing unit which in turn transfers the weight of the string to the well head. The washing unit is constructed of heavy gauge materials that are strong enough to bear the weight of the string. The fluid under pressure is directed through the nozzles onto the string to flush pollutants off of the string and back through the well head and into the well. A recovery tank is used as desired with a seal disposed near the bottom of the washing unit to prevent the fluid from being flushed back into the well. A drain hose connects the recovery tank to the washing unit for collection of the fluid and pollutants.

17 Claims, 3 Drawing Sheets

OIL WELL HEAD CLEANING SYSTEM

BACKGROUND OF THE INVENTION

1. Field of the Invention

The present invention, in general, relates to apparatus which mount atop an existing oil well head and, more particularly, to systems which clean pipe, rod, and cable being extracted from oil wells.

During drilling of an oil well, drills strings and the like are periodically removed from the well. Devices which clean the oil off of the drill strings are known. These devices for cleaning oil wells during drilling of the well support the weight of the drill string that is being extracted by the equipment that is used for drilling the well. The equipment for drilling oil wells and for support of cleaning devices during drilling are commonly referred to as Overhead Rotary Tables.

Existing oil wells periodically require servicing which may include making repairs to pump motors and the like. Also for many other reasons the pipe, electrical cable, or rods which enter into the well must periodically be extracted. During this servicing the pipe and electrical cable which may be present in the oil well must be extracted. For certain other types of oil wells, an overhead "beam" type of pump transfers power into the well by a series of "rods" which are joined together and which must also be extracted periodically. It is preferable to remove the oil from these extracted components so that the oil does not pollute the ground. Ideally the oil is best removed from the devices so that it reenters the oil well itself.

Know prior types of devices for cleaning the pipe and electrical cable of existing oil wells rely upon rubber types of wipers which squeegee some of the oil off of the pipe and cable as it is being extracted from the well. However these devices fail to remove much of the oil that is present on the "string" that is being extracted.

There is no known way of extracting the oil and flushing it back into the well by utilizing a device which both is capable of bearing the weight of the pipe and cable (known as the "production string") or the weight of the rod (known as the "rod string") being extracted and which is also capable of flushing the oil back into the well.

Accordingly there exists today a need for an oil well head cleaning system that can support the weight of the pipe and cable or rod that is being extracted and which is able to flush a significant quantity of oil off of the extracted string.

2. Description of Prior Art

Oil drill string cleaning systems are, in general, known. For example, the following patents describe various types of these devices:

U.S. Pat. No. 1,038,231 to Taylor & Wolfe, Sep. 10, 1912;

U.S. Pat. No. 2,514,817 to Wheaton et al, Jul. 11, 1950;

U.S. Pat. No. 2,611,146 to Buckley, Sep. 23, 1952;

U.S. Pat. No. 2,620,504 to Slater, Dec. 9, 1952;

U.S. Pat. No. 2,914,786 to Hunt, Dec. 1, 1959;

U.S. Pat. No. 3,071,796 to Waldrop, Jan. 8, 1963;

U.S. Pat. No. 3,475,781 to Grant, Nov. 4, 1969;

U.S. Pat. No. 3,626,540 to Rood, Dec. 14, 1971;

U.S. Pat. No. 3,822,753 to Tate, Jul. 9, 1974;

U.S. Pat. No. 4,399,869 to Bentley, , 19;

U.S. Pat. No. 4,895,205 to Thompson et al, Jan. 23, 1990;

U.S. Pat. No. 5,101,896 to Thompson et al, Apr. 7, 1992; and

U.S. Pat. No. 5,217,069 to Badon, Jun. 8, 1993.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide an Oil Well Head Cleaning system that is capable of supporting the weight of a production string that is being extracted and cleaned.

It is also an important object of the present invention to provide an Oil Well Head Cleaning system that is capable of supporting the weight of a rod string that is being extracted and cleaned.

It is also an object of the invention to provide an Oil Well Head Cleaning system that is portable.

Still another object of the invention is to provide an Oil Well Head Cleaning system that can be attached on top of an oil well head.

Yet another object of the invention is to provide an Oil Well Head Cleaning system than is able to flush the pollutants and the cleaning fluid back into the oil well.

Still yet another object of the invention is to provide an Oil Well Head Cleaning system than is able to flush the pollutants and the cleaning fluid into a recovery tank for reuse or for safe disposal elsewhere.

Another object of the invention is to provide an Oil Well Head Cleaning system that can clean the inside of the sections of pipe of a production string.

Still yet another very important object of the invention is to provide an Oil Well Head Cleaning system that can clean the outside of the sections of pipe and the electrical cable of a production string.

Briefly, an oil well head cleaning system that is constructed in accordance with the principles of the present invention includes a washing unit having a first section and a second section which are assembled together on top of an existing oil well head. The first and second sections when assembled, are capable of bearing the weight of a production string or rod string that is being extracted from the well. A tubing slip is placed atop the washing unit and prevent the production string from slipping down back into the well during extraction and cleaning thereof. (A rod table is similarly used atop a modified cleaner to hold the rod string.) Fluid under pressure is supplied though a main hose to a plurality of exterior nozzles that are useful for cleaning the outside surfaces of the production string that are disposed within the washing unit by flushing off the fluid, oil, and other pollutants which are on the exterior of the production string (or the rod string) that is being extracted out of the oil well head and back into the oil well or alternatively into a recovery tank as described in greater detail hereinbelow. A seal that is affixed to the top of the cleaner scrapes off additional pollutants that were not removed by flushing and helps to prevent splashback of the fluid out of the washing unit. A center flush valve redirects the fluid through a second (flush) hose through a center flush nozzle to the inside of the production string pipe to clean pollutants therefrom and to flush them back into the well. A plurality of control valves as desired are used to direct the fluid as necessary. According to a modification, a lower elastic boot is also affixed to the bottom of the cleaner and a drain hose are provided for the draining of fluid and pollutants from the pipe back into a recovery tank that is disposed near the well head, but at a slightly lower elevation for gravity draining to occur. The recovery tank is used as desired to collect cleaning fluid and pollutants when it is not desirable to flush them back into the well.

DETAILED DESCRIPTION OF THE INVENTION

Figure 1:
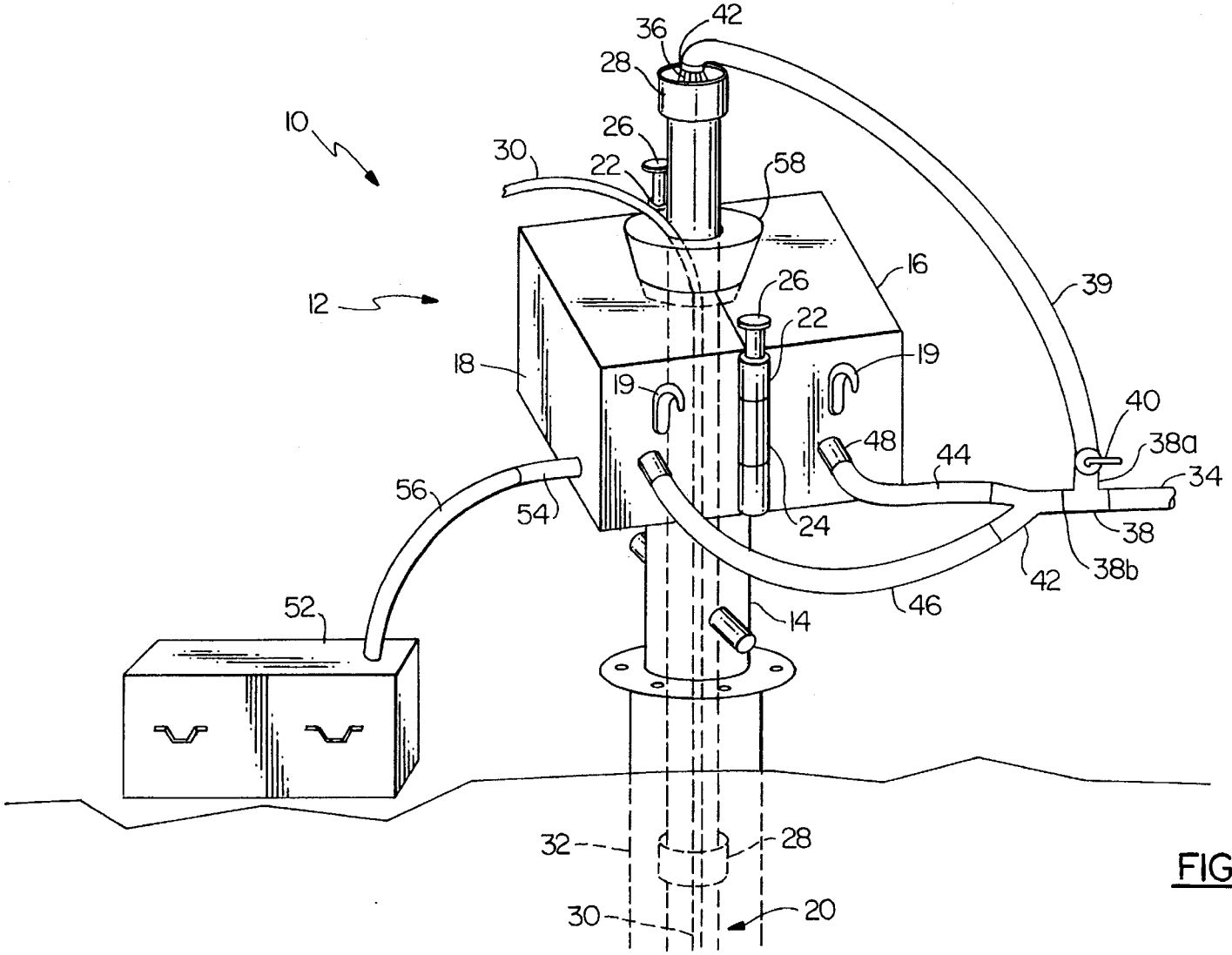
FIG. 1 is a view in perspective of an oil well head cleaning system atop a well head useful for cleaning of a production string.

Referring to FIG. 1 is shown, an oil well head cleaning system, identified in general by the reference numeral 10. The cleaning system 10 consists of a washing unit 12 which is placed atop an existing oil well head 14.

The washing unit 12 is comprised of first half 16 and a second half 18 which facilitate handling and mounting atop the well head 14. The washing unit 12 must bear the entire weight of a production string 20 or a rod string (reference numeral 88 FIG. 3).

Accordingly it must be constructed, as is described in greater detail hereinbelow, strong enough to bear these significant weights. As a result the washing unit 12 is heavy, and is constructed in two halves 16, 18 primarily to aid in transport. Also the ability to separate the first half 16 apart from the second half 18 allows for servicing and customization of the washing unit 12 to occur as is also described in greater detail hereinbelow. A plurality of lifting hooks 19 are attached where desired to the first half 16 and the second half 18 to aid in lifting and moving.

Figure 2:
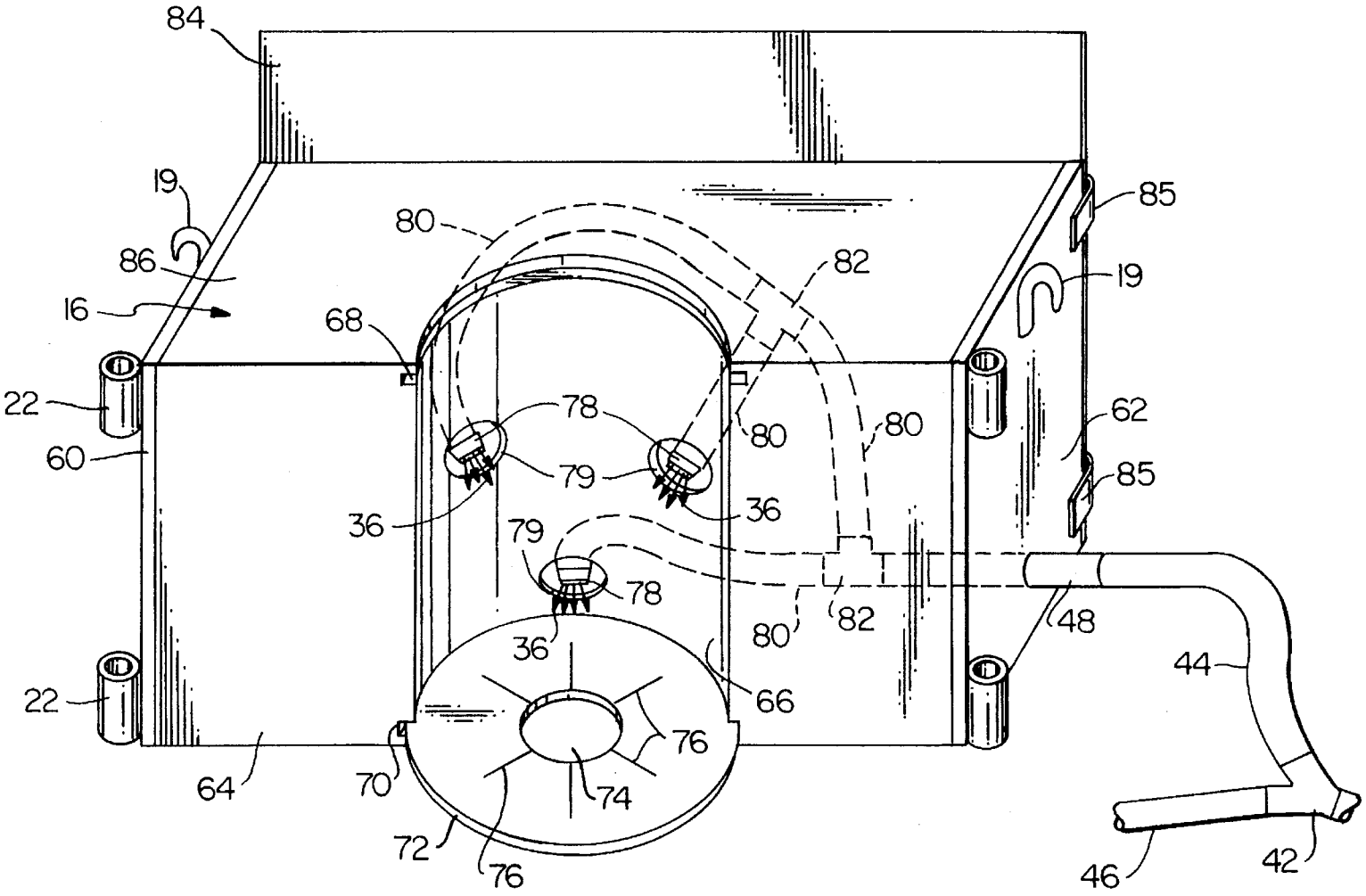
FIG. 2 is a view in perspective of one half of the oil well head cleaner to show additional detail of construction.
Figure 3:
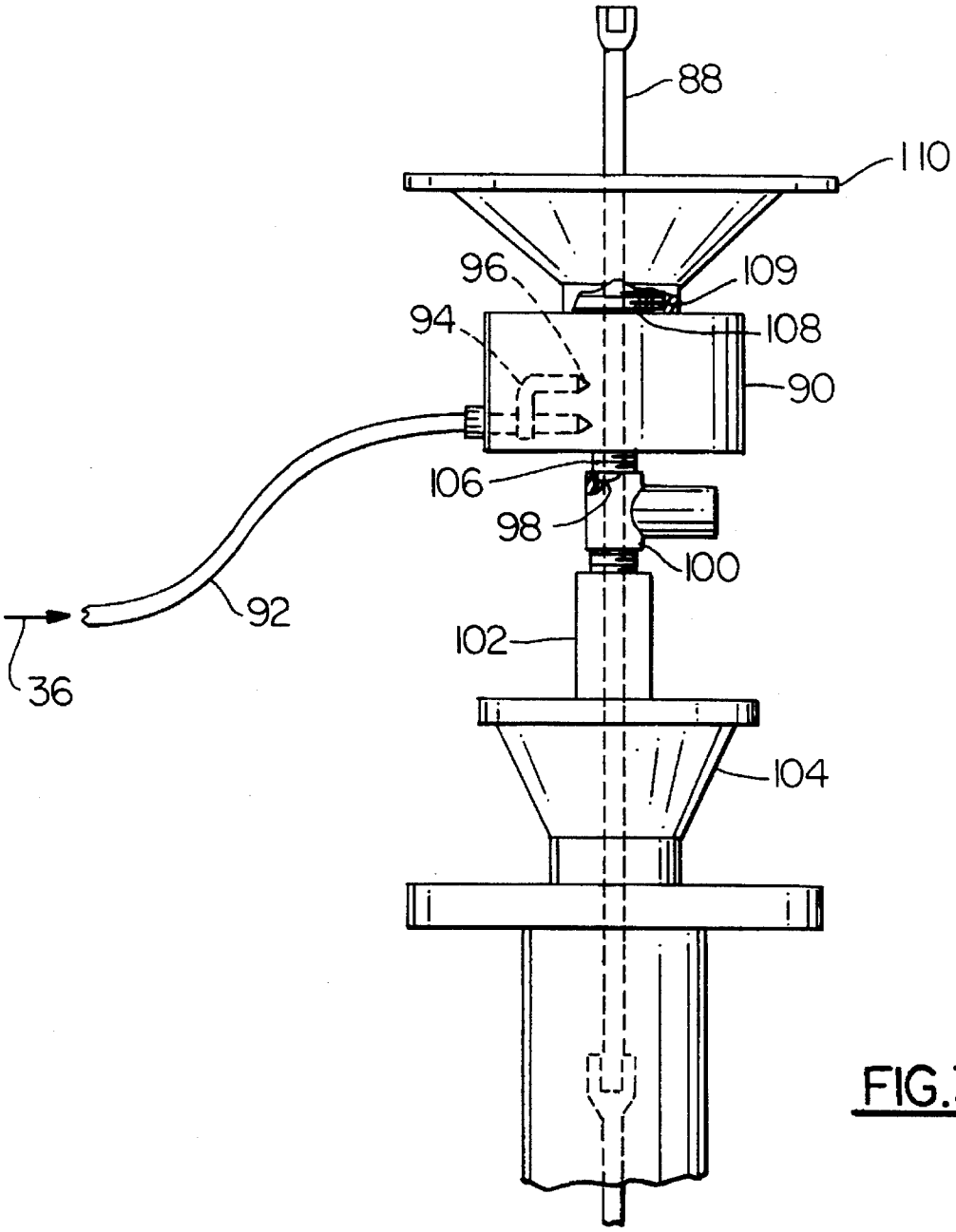
FIG. 3 is a side view of a modified cleaner useful for cleaning of a rod string.

On occasion it will be helpful to refer to FIGS. 2 and 3. FIG. 2 shows only the first half 16 of the washing unit 12. FIG. 3 shows a modified washing unit 90 that is adapted for cleaning of the rod string 88.

Referring again primarily to FIG. 1, at least one ring 22 is attached to each side of the first half 15 and at least one matching ring 24 is attached to each side of the second half 18. The ring 22 and matching ring 24 on each side of the washing unit 12 align when the first half 16 and the second half 18 are assembled together over the well head 14. A pin 26 passes through both the ring 22 and matching ring 24 on each side of the washing unit 12 to hold the first half 16 and the second half 18 together atop of the well head 14.

The assembled washing unit 12 normally rests atop the well head 14. There is usually no reason to fasten it to the well head as the weight and position of the production string 20 tends to hold the washing unit 12 in proper alignment atop the well head 14. However though no form of attachment to the well head 14 is shown, if desired the washing unit 12 could be clamped or bolted to the well head.

The production string 20 normally includes a plurality of sections of production pipe 28, each of which are joined together by threads. The production string 20 also normally includes an electrical cable 30 which runs along side and is fastened at predetermined locations to the sections of production pipe 28 and which supplies electrical power to a pump (not shown) that is disposed lower in the well and is attached to the end of the bottom section of pipe 28.

A casing 32 is part of the oil well and is in fact an outer conduit which surrounds both the cable 30 and the pipe 28. The pipe 28 is itself, an inner conduit through which oil is pumped out of the well by the pump and to the surface where it is treated to remove water and the like.

A main hose 34 (only a portion of which is shown) is connected at a first end (not shown) to a source of fluid 36 under pressure. The fluid 36 is usually heated water and may contain additives which aid in removing pollutants off of the production string 20. The fluid 36 is shown in FIG. 2 and at the top of the string 20 of FIG. 1 as it is being sprayed either onto the pipe 28 or into an open end of one section of the pipe 28.

The term pollutants refers in general to anything which adheres to the production string 20 as it is being extracted from the well. Normally the main pollutant is oil. However the cleaning system 10 is useful in removing virtually all types of pollutants off of the string 20 as may occur in various oil wells. This is true because any necessary types of additives (not shown) may be added to the fluid 36 or any special type of a cleaning fluid (not shown) that is comprised of any desired chemical or chemicals may be substituted in place of the fluid 36 to aid in removing various pollutants.

The source of the fluid 36 that is supplied to the main hose 34 under pressure is not shown, but it is usually a high pressure pump that is connected to one end of the main hose 34. The pump may be a portable pump (not shown) that is mounted on a truck or a trailer or it may be a high pressure pump that is permanently mounted (not shown) near the well. A low pressure pump (not shown) may be used in certain applications as preferred to supply the fluid 36 under pressure to one end of the main hose 34.

A tee fitting 38 is attached to the remaining end of the main hose 34 and allows for diversion of the fluid 36 as described hereinbelow. A center flush valve 40 is attached to a first section 38*a* of the tee fitting 38. When fluid 36 under pressure is supplied to the main hose 34 and when the center flush valve 40 is opened fluid 36 passes out of the first section 38*a* through a second hose 39 until it is expelled under pressure through a center flush nozzle 42 which directs the fluid 36 into the open end of one section of the pipe 28 for cleaning the inside of that particular section of pipe 28.

The fluid 36 that enters into the pipe 28 runs down all of the sections of pipe 28 and out of the pump into the well. The second hose 39 is secured in position by any preferred type of a clamp (not shown) or is held in position by an operator (not shown).

Additional valves (not shown) may be attached anywhere desired to further direct and control the flow of the fluid 36 as desired. All possible locations for the additional valves are not shown as the use of such is considered obvious to those skilled in the art.

When fluid 36 is supplied to the main hose 34, as shown, and regardless of the position of the center flush valve 40, it also passes out of a second section 38b of the tee fitting 38 and into a Y-fitting 42. A second tee fitting (not shown) can of course be used in place of the Y-fitting 42, however the Y-fitting 42 allows the fluid 36 passing therein to flow better than would the use of the second tee fitting. Similarly a second Y-fitting (not shown) may be used in lieu of the tee fitting 38.

The fluid 36 exits the Y-fitting 42 and enters into a third hose 44 and a fourth hose 46. The third hose 44 transports the fluid 36 to a first inlet port 48 which in turn transports the fluid 36 into the first half 16 of the washing unit 12 as is described in greater detail hereinbelow. The fourth hose 46 similarly transports the fluid 36 into a second inlet port 50 attached to the second half 18 of the washing unit 12.

A recovery tank 52 for collection of the fluid 36 and pollutants is shown attached to a drain outlet 54 on the second half 18 of the washing unit 12. If preferred the drain outlet 54 can be attached to the first half 16 equally well. A drain hose 56 conducts fluid 36 and pollutants to the recovery tank 52 for possible re-use or safe disposal.

A tubing slip 58 is disposed around one section of pipe 28 on top of the washing unit 12. The tubing slip is a well known device that is used in the petroleum industry and elsewhere. It allows for the pipe 28 to be extracted in one direction without significant resistance (out of the well) and it prevents the pipe 28 from passage in the opposite direction (back into the well). As it is a well known component and also because any method of securing the pipe 28 in position can be used with the cleaning system 10, it is not described in great detail other than its operation which is described hereinbelow.

During use of the cleaning system 10, the entire production string 20 is lifted out of the casing 32 by any preferred method (not shown) which could be either a winch, a crane, or an overhead boom. The tubing slip 58 allows the string 20 to be lifted. When the force that is used to lift the string 20 is stopped the string 20 begins to settle back into the oil well slightly which in turn causes the tubing slip 58 to engage the section of the pipe 28 inside of it. Accordingly the tubing slip 58 bears against the top of the washing unit 12 and prevents the string 20 from receding further back into the casing 32.

Referring primarily to FIG. 2, is shown the first half 16 of the washing unit 12. The second half 18 is substantially the same as the first half 16 other than the difference in the positioning of the ring 22 and the matching ring 24. Therefore the description of the construction and of the operation of the first half 16 apply equally to the second half 18 and are not repeated.

The first half 16 is substantially a box shaped assembly, the sides of which are reinforced as desired to support the weight of the production string, which can be many thousands of pounds. The most common method to reinforce the first half 16 is by the use of heavy gauge steel plate for construction of a first side panel 60, a second side panel 62, and a third inner panel assembly 64. Steel plate approximately one-half inch thick is preferred although thinner stock may also be used for certain applications.

The third inner panel assembly 64 includes a concave portion 66 that is larger than the greatest outside diameter of any portion of the pipe 28 of the production string 20. An upper recess 68 and a lower recess 70 are provided in the concave portion 66 in close proximity to the top and the bottom thereof.

The upper recess 68 and the lower recess 70 are adapted to each receive a lower seal 72 and an upper seal (not shown). The upper seal is not shown because it would obstruct detail and is identical to the lower seal 72. The upper seal is always used with the cleaner system 10. However the lower seal 72 is used only when fluid 36 is to be directed into the recovery tank 52.

When it is desired that fluid 36 be directed into the recovery tank 52 rather than be allowed to flow back into the oil well, the lower seal is applied over the top section of the pipe 28 and is positioned where the lower recess 70 is located. The upper seal is similarly applied over the top section of the pipe 28 and is positioned where the upper recess 68 is located. As the first half 16 and the second half 18 of the washing unit 12 are assembled together on top of the well head 14, the upper seal and the lower seal 72 engage respectively with the upper recess 68 and the lower recess 70. Of course the recovery tank 52 is connected to the drain outlet 54 by the drain hose 56 that is placed and connected intermediate thereof.

The lower seal 72 and the upper seal are constructed the same therefore the description of the lower seal 72 is to be applied to the upper seal that is not shown also. The lower seal 72 is disk like in shape with a center hole 74 that is normally made of heavy rubber or similar material.

The center hole 74 provides a tight fit around the production string 20. A plurality of slits 76 are disposed radially about the center hole 74 and extend a predetermined distance from the center hole 74 toward the outside perimeter of the lower seal 72. The slits 76 allow the lower seal 72 to be forced over the string 20 whilst still maintaining a tight seal around the sections of the pipe 28 which comprises the string 20.

When the fluid 36 is allowed to flow back into the well instead of into the recovery tank 52, the lower seal 72 is omitted. The drain hose 56 is disconnected apart from the drain outlet 54 and the drain outlet 54 is obstructed by placing a cap (not shown) or other suitable seal on the end thereof.

The fluid 36 then flows around the pipe 28 and back down into the well head 14, through the casing 32 and back into the well. As the fluid 36 can be directed to flow either back into the oil well or recovered in the recovery tank 52 as desired, the cleaning system 10 thus provides a method to either reclaim the fluid 36 or to dispose of it back into the well.

A plurality of exterior nozzles 78 are disposed where desired along the concave portion 66 so as to direct the fluid 36 toward the pipe 28 (not shown in FIG. 2) for cleaning the pollutants therefrom. The exterior nozzles 78 preferably direct the fluid 36 slightly downward toward the well head 14 to prevent excessive splashback of the fluid 36 from occurring out through the upper seal.

A plurality of interior hoses 80 (shown in dashed lines) and a plurality of interior fittings 82 (shown in dashed lines) direct the fluid 36 from the first inlet port 48 to the exterior nozzles 78. As many exterior nozzles 78 as desired are used and are disposed where desired along the concave portion 66. The exterior nozzles 78 are mounted so as to align with a plurality of holes 79 that are provided in the concave portion 66. The exterior nozzles 78 are nearly flush with the surface of the concave portion 66 and therefore will not be damaged by the sections of the pipe 28. The holes 79 allow for fluid 36 to pass out of the exterior nozzles 78 and to impact upon the pipe 28.

A lighter gauge rear panel 84 is shown in a slightly elevated position from normal. Retaining clamps 85 maintain the rear panel 84 in position as it slides along the back of the first half 16. The rear panel 84 can be lifted entirely off of the first half 16 to allow for access to the interior hoses 80, the interior fittings 82, and the exterior nozzles 78 for repair and cleaning. As the rear panel 84 provides access rather than structural integrity, it can be made of considerably lighter gauge materials than the remainder of the first half of the washing unit 12. Accordingly a top 86 and a bottom (not shown) of the first half 16 are also constructed of heavy gauge materials for strength.

Referring now primarily to FIG. 3, is shown a modified washing unit 90 for cleaning of the rod string 88. Fluid 36 flows through a modified hose 92 and into the modified unit 90 where modified inner hoses 94 direct it to modified inner nozzles 96 from where it is sprayed onto the rod string 88.

The modified unit 90 is sized to fit and cooperated with threads 98 of a production tee 100. The production tee 100 normally is attached to an end of a production tube 102. A modified well head 104 contains the production tube 102.

The modified unit 90 includes lower threads 106 and upper threads 108. The lower threads 106 cooperate with the threads 98 of the production tee 100. The upper threads 108 cooperated with threads 109 of a rod table 110. The rod table 110 holds the rod string 88 similar to the manner by which the tubing slip 58 secures the production string 20.

OPERATION

Whether the fluid 36 is to be directed into the casing 32 or into the recovery tank 52, cleaning of the sections of pipe 28 is further described hereinbelow. The following description of operation applies primarily to the extraction and cleaning of the production string 20. For cleaning of the rod string 88 no center flushing is possible as the rod string 88 is not hollow core but rather solid.

The first section of the pipe 28 is cleaned by directing fluid 36 to flow through the second hose 39 and into the end of the pipe if it is desired to clean the inside of the pipe as was described hereinabove for each section of the pipe 28 of the string 20.

To clean the outside of the pipe 28, fluid 36 is directed to flow through the third hose 44 and the fourth hose 46 and into the first half 16 and into second half 18 where it emerges from each of the exterior nozzles 78 and onto the outside of the pipe 28 and also on the electrical cable 30. The entire string 20 is progressively raised at any desired rate while discharge of the fluid 36 continues through the exterior nozzles 78 until one entire section of the pipe 28 has been cleaned.

The cable 30 is separated apart from the raised and now cleaned section of the pipe 28 and is captured on a take-up spool (not shown). The section of the pipe 28 that has been cleaned is then disassembled apart from the remaining sections of the pipe 28 which comprise the string 20. The tubing slip 58 holds the string 20 in position while the cleaned section of pipe 28 is removed.

The process is then repeated for as many sections of the pipe 28 as there are. Accordingly the pollutants which are on the string 20 are substantially removed off of the sections of the pipe 28 and also off of the cable 30. The inside of the pipe 28 is also cleaned as desired one section of the pipe 28 at a time in the manner as was described in greater detail hereinabove when these components (i.e.; the flush valve 40; the second hose 39; and the center flush nozzle 42) were previously described.

Less environmental pollution of the surface of the ground is the result for either flushing the fluid 36 back through the casing 32 and into the well or for recovering the fluid 36 by diverting its flow into the recovery tank 52. Use of the cleaning system 10 thus prevents pollutants which were otherwise present both on and in the sections of the pipe 28 of the production string 20 from contaminating the ground near oil wells during servicing of existing oil wells.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An oil well head cleaning system for use at an oil well, comprising:

(a) a washing unit adapted for placement upon a well head, said washing unit including a first section and a second section that are separable with respect to each other and, when said first section and said second section are placed atop said well head, attach together to form said washing unit, said washing unit having a center opening adapted to surround an oil well string and having sufficient strength to bear a weight of said string and of transferring said weight to said well head, each of said first section and said second section including an inlet port and a plurality of interior hoses each of said plurality of interior hoses adapted to form a conduit, said conduit adapted to convey a fluid from said inlet port through said plurality of interior hoses and thorough a plurality of interior fittings to a plurality of nozzles, each said nozzles disposed around said center opening so as to direct said fluid on said string;

(b) means for supporting said string at a desired elevation with respect to said well head on said washing unit; and (c) means for supplying said fluid under pressure to said inlet port of said first section and to said inlet port of said second section including means for directing the flow of said fluid.

2. The oil well head cleaning system of claim 1 wherein said first section includes a substantially cubical structure having a first upstanding side panel, a second upstanding side panel disposed apart from said first side panel, and an upstanding inner panel assembly disposed intermediate said first side panel and said second side panel including a concave portion that is larger than the diameter of said string, said concave portion adapted to form one-half of said center opening, a top and a bottom disposed in a spaced apart relationship with respect to each other and attached to said first side panel, said second side panel and said inner panel assembly, said first side panel, said second side panel, said top, said bottom, and said inner panel assembly being adapted to support said weight of said string and including means for attaching said first section to said second section.

3. The oil well head cleaning system of claim 2 wherein said first section includes means for providing a first seal at said center opening adjacent to said top, said first seal disposed intermediate said string and said first section.

4. The oil well head cleaning system of claim 2 wherein said first section includes means for providing a second seal at said center opening adjacent to said bottom, said second seal disposed intermediate said string and said first section.

5. The oil well head cleaning system of claim 1 wherein said second section includes a substantially cubical structure having a first upstanding side panel, a second upstanding side panel disposed apart from said first side panel, and an upstanding inner panel assembly disposed intermediate said first side panel and said second side panel including a concave portion that is larger than the diameter of said string, said concave portion adapted to form one-half of said center opening, a top and a bottom disposed in a spaced apart relationship with respect to each other and attached to said first side panel, said second side panel and said inner panel assembly, said first side panel, said second side panel, said top, said bottom, and said inner panel assembly being adapted to support said weight of said string and including means for attaching said second section to said first section.

6. The oil well head cleaning system of claim 2 wherein said second section includes means for providing a first seal at said center opening adjacent to said top, said first seal disposed intermediate said string and said second section.

7. The oil well head cleaning system of claim 2 wherein said second section includes means for providing a second seal at said center opening adjacent to said bottom, said second seal disposed intermediate said string and said second section.

8. The oil well head cleaning system of claim 1 wherein said string includes a production string.

9. The oil well head cleaning system of claim 8 wherein said system includes means for supplying said fluid under pressure to the interior of said production string.

10. The oil well head cleaning system of claim 1 wherein said string includes a rod string.

11. The oil well head cleaning system of claim 1 including means for directing said fluid off of said string and into said oil well.

12. The oil well head cleaning system of claim 1 including means for directing said fluid off of said string and into a drain hose that provides a conduit to conduct said fluid to a recovery tank.

13. The oil well head cleaning system of claim 1 wherein said means for supporting said string includes a tubing slip.

14. The oil well head cleaning system of claim 1 wherein said means for supporting said string includes a rod table.

15. The oil well head cleaning system of claim 1 including at least one hook attached to said washing unit and adapted for lifting of said washing unit.

16. The oil well head cleaning system of claim 1 wherein said means for supplying said fluid includes a pump.

17. The oil well head cleaning system of claim 1 wherein said means for directing includes at least one valve attached to at least one exterior hose, said at least one exterior hose attached at a first end to said at least one valve and attached at a second end to said means for supplying said fluid.

* * * * *